US006152090A

United States Patent [19]

Fujimoto et al.

[11] Patent Number: 6,152,090

[45] Date of Patent: Nov. 28, 2000

[54] ENGINE CYLINDER BLOCK

[75] Inventors: Hiroya Fujimoto, Zushi; Toshimitsu Matsuoka, Yokosuka, both of Japan

[73] Assignee: Nissan Motor Co., Ltd., Kanawaga-Ken, Japan

[21] Appl. No.: 09/093,933

[22] Filed: Jun. 9, 1998

[30] Foreign Application Priority Data

Jun. 16, 1997 [JP] Japan ..... 9-159009

[51] Int. Cl.[7] ..... F02B 75/18

[52] U.S. Cl. ..... 123/41.74; 123/41.5; 123/193.2

[58] Field of Search ..... 123/41.5, 41.72, 123/41.74, 193.2, 196 M, 41.81, 196 R

[56] References Cited

U.S. PATENT DOCUMENTS

| | | | |
|---|---|---|---|
| 1,271,419 | 7/1918 | Bergdoll | 123/41.72 |
| 1,305,041 | 5/1919 | Westergaard | 123/41.5 |
| 2,734,497 | 2/1956 | Chayne | 123/41.74 |
| 3,492,977 | 2/1970 | Fager | 123/193.2 |
| 3,674,000 | 7/1972 | Reisacher et al. | 123/193.3 |
| 4,419,970 | 12/1983 | Shaw | 123/41.74 |
| 4,742,803 | 5/1988 | Chiles et al. | 123/196 M |
| 4,846,116 | 7/1989 | Sakurahara et al. | 123/41.74 |
| 5,148,782 | 9/1992 | Kramer et al. | 123/195 R |
| 5,474,040 | 12/1995 | Murakami et al. | 123/195 R |

FOREIGN PATENT DOCUMENTS

| | | | |
|---|---|---|---|
| 0 861 998 | 9/1998 | European Pat. Off. . | |
| 15 76 407 | 5/1970 | Germany . | |
| 59-54755 | 3/1984 | Japan . | |
| 8-061139 | 3/1996 | Japan . | |
| 10689 | 4/1909 | United Kingdom | 123/41.81 |
| 2 310 704 | 9/1997 | United Kingdom . | |

*Primary Examiner*—Noah P. Kamen
*Attorney, Agent, or Firm*—McDermott, Will & Emery

[57] ABSTRACT

In an engine cylinder block, a water jacket base wall is formed between a lower end of a water jacket outer wall and an intermediate part of a cylinder wall. A head bolt boss is formed in the water jacket outer wall for screwing in a head bolt. A thin part is formed in an intermediate part of the water jacket base wall. The rigidity of the water jacket base wall thereby falls, a force in the axial direction of the head bolt due to tightening of the head bolt or input of combustion pressure is absorbed by deformation of the water jacket base wall, and deformation of the cylinder wall is suppressed.

13 Claims, 14 Drawing Sheets

ENGINE CYLINDER BLOCK

The contents of Tokugan Hei P9-159009, with a filing date of Jun. 16, 1997 in Japan, and on which the claim to priority of this application is based are hereby incorporated by reference.

FIELD OF THE INVENTION

The present invention relates to improvement of a cylinder block of a water-cooled engine.

BACKGROUND OF THE INVENTION

Tokkai Hei 2-153249 published by the Japanese Patent Office in 1990 discloses an engine cylinder block for a water-cooled engine wherein a water jacket is formed around a cylinder wall, and the heat of the cylinder wall is absorbed by circulating cooling water in this water jacket.

In one kind of cylinder block, the bottom wall of the water jacket is connected to an intermediate part of the cylinder wall, and the water jacket is formed only around the upper part of the cylinder wall. In this way excessive cooling of the cylinder wall is prevented, warm up is promoted, and exhaust performance and heater performance are improved.

In an engine having a cylinder head fitted to the upper end of the cylinder block by head bolts, when the water jacket bottom wall is connected to the intermediate part of cylinder wall, an axial force which acts on the head bolts due to tightening of the head bolts or input of combustion pressure, is transmitted to the cylinder wall via the water jacket bottom wall from a head bolt boss. Therefore, the cylinder wall may deform and cause scuffing of the cylinder bores, which leads to an increase of oil consumption.

SUMMARY OF THE INVENTION

It is therefore an object of this invention to suppress the axial force of a head bolt from being transmitted to a cylinder wall, and therefore to suppress deformation of the cylinder wall.

In order to achieve the above object, this invention provides a cylinder block of a water-cooled engine comprising a cylinder wall housing a piston free to slide, a water jacket outer wall covering the upper part of the cylinder wall with a gap, a water jacket base wall connecting the lower end of the water jacket outer wall and the cylinder wall, the cylinder wall, water jacket outer wall and water jacket base wall forming a water jacket into which cooling water is led. The cylinder block further comprises a thin part which is thinner than other parts of the water jacket base wall is formed at a predetermined position of the water jacket base wall.

According to an aspect of this invention, the water jacket base wall slopes downward from the water jacket outer wall to the cylinder wall.

According to another aspect of this invention, the thin part is formed further towards the outside than the center of the width of the water jacket.

According to yet another aspect of this invention, the thin part is formed by hollowing either of an inner surface and an outer surface of the water jacket base wall with a predetermined curvature.

According to yet another aspect of this invention, the thin part is directly connected to the water jacket outer wall. Preferably, the thin part is formed further towards the outside than the center of the width of the water jacket.

According to yet another aspect of this invention, the thin part is formed by providing a groove along the cylinder wall in either of an inner surface and an outer surface of the water jacket base wall. Preferably, the thin part is formed further towards the outside than the center of the width of the water jacket.

According to yet another aspect of this invention, the thin part is formed by providing plural concave parts in either of an inner surface and an outer surface of the water jacket base wall. Preferably, the thin part is formed further towards the outside than the center of the width of the water jacket.

According to yet another aspect of this invention, the cylinder block further comprises a head bolt boss into which a head bolt is screwed and a rib connecting the water jacket base wall with the cylinder wall in a position facing the head bolt boss.

According to yet another aspect of this invention, the cylinder block further comprises a head bolt boss into which a head bolt is screwed and a wall in a rib shape projecting from the head bolt boss. The wall has an oil trap therein and the depth of the water jacket is deepened in a part adjacent to the oil trap.

According to yet another aspect of this invention, the cylinder block further comprises a gallery wall which connects the cylinder wall with the water jacket base wall, and an oil gallery formed by the water jacket base wall, the cylinder wall and the gallery wall.

The details as well as other features and advantages of this invention are set forth in the remainder of the specification and are shown in the accompanying drawings.

DESCRIPTION OF THE PREFERRED EMBODIMENTS

Figure 1:
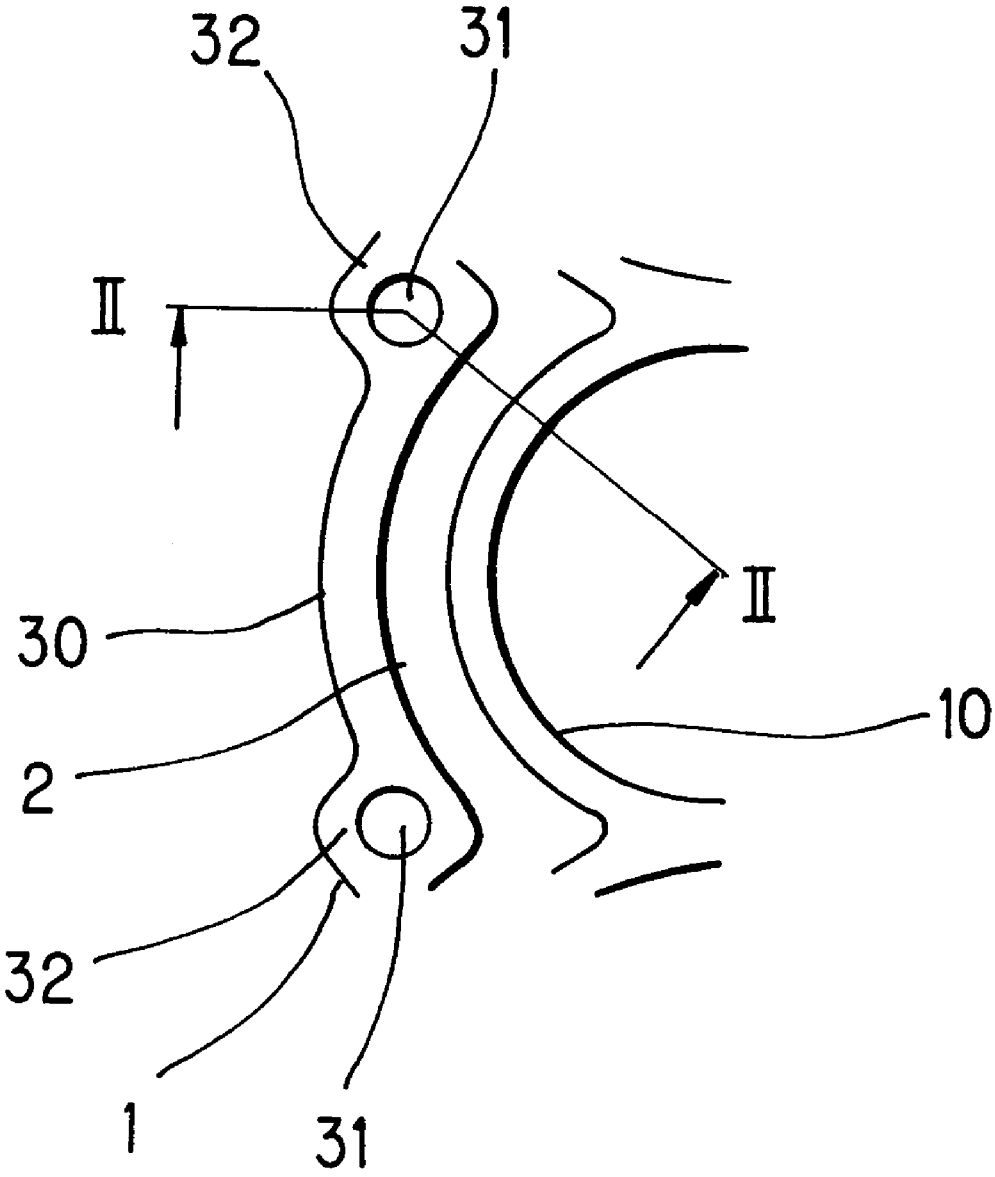
FIG. 1 is a partial plan view of a cylinder block according to a first embodiment of this invention.
Figure 2:
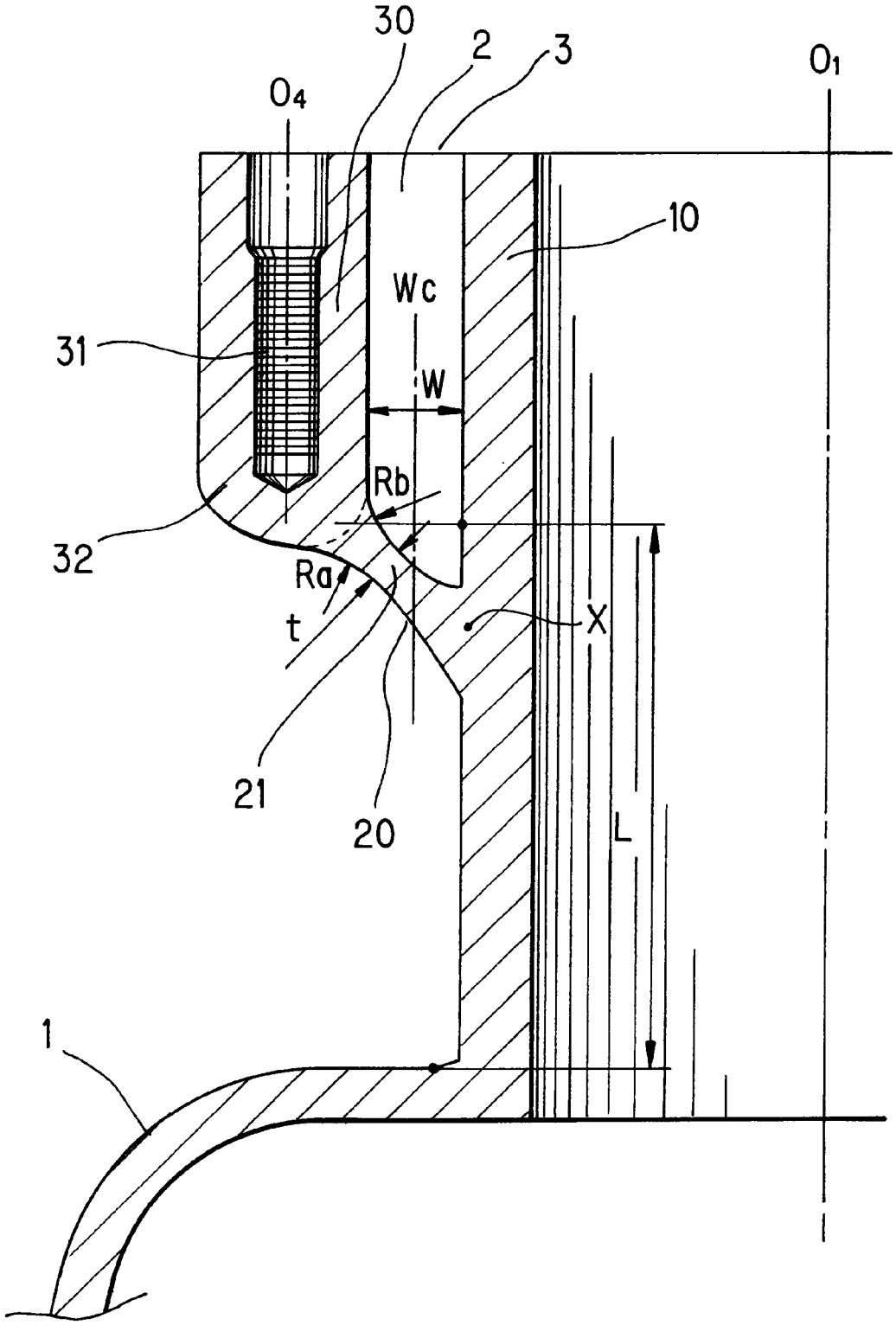
FIG. 2 is partial sectional view of the cylinder block taken along a line II—II in FIG. 1.

Referring to FIG. 1 and FIG. 2 of the drawings, a cylinder block 1 is provided with a water jacket 2 outside a cylinder wall 10 housing a piston free to slide. The water jacket 2 is formed by the cylinder wall 10, a water jacket outer wall 30 surrounding the cylinder wall 10 with a predetermined gap, and a water jacket base wall 20 connecting the lower end of the water jacket outer wall 30 and the cylinder wall 10. The water jacket base wall 20 is connected to a predetermined position in the piston slide range of the cylinder wall 10.

The cylinder block 1 is a so-called open deck type, the upper end of the water jacket 2 being open. The cylinder block 1 is formed of aluminum alloy by die-casting in a mold.

Cooling water sent from a water pump, not shown, passes through the water jacket 2, and circulates around the cylinder wall 10 so as to absorb the heat of the cylinder wall 10. This cooling water flows from an upper end opening 3 of the water jacket 2 into a water jacket in a cylinder head, not shown, via connecting holes. A head bolt boss 32 for providing a bolt hole 31 into which a head bolt screws is formed in the water jacket outer wall 30. The head bolt boss 32 is provided between cylinders and at both ends of the cylinder block 1 when viewed from the left side of FIG. 2. The cylinder head is tightened to the cylinder block 1 when the head bolt, not shown, screws into the bolt hole 31 through the cylinder head.

The water jacket base wall 20 is inclined relative to a cylinder center line $O_1$, and slopes away to the cylinder wall 10 from the water jacket outer wall 30. The water jacket base wall 20 is connected to the cylinder wall 10 at a point X in FIG. 2 within a range L from the lower end of the head bolt boss 32 to the lower end of the cylinder wall 10. The angle formed by the water jacket base wall 20 and the upper part of the cylinder wall 10 is an acute angle, and the angle formed by the water jacket base wall 20 and water jacket outer wall 30 is an obtuse angle.

The inner and outer surfaces of the water jacket base wall 20 are hollowed out with predetermined curvatures Rb, Ra. Due to this, a thin part 21 is formed in the intermediate part of the water jacket base wall 20 whereof the thickness t is less than that of other parts of the water jacket base wall 20. This thin part 21 is formed more towards the outside than the center Wc of the width W of the water jacket 2. The wall thickness t of the water jacket base wall 20 progressively becomes smaller from a point connected to the water jacket outer wall 30 or the cylinder wall 10 towards the thin part 21, and is a minimum in the thin part 21.

In FIG. 1, when the cylinder head, not illustrated, is tightened to the cylinder block 1 by the head bolt, an upward force acts on the head bolt boss 32 due to the axial-force of the head bolt. If the rigidity of the water jacket base wall 20 is high, this upward force is transmitted to the cylinder wall 10 via the water jacket base wall 20, and the cylinder wall 10 deforms.

However, according to this invention, the thin part 21 is formed in an intermediate part of the water jacket base wall 20, so the rigidity of the water jacket base wall is lower. Due to this, deformation of the head bolt boss 32 is absorbed by elastic deformation of the water jacket base wall 20, and deformation of the cylinder wall 10 is suppressed.

Also, as the water jacket base wall 20 is inclined relative to the cylinder center line $O_1$, the length of the water jacket base wall 20 is longer. As a result, the water jacket base wall 20 easily sags, deformation of the head bolt boss 32 is absorbed by deformation of the water jacket base wall 20, and deformation of cylinder wall 10 is further suppressed.

Further, the thin part 21 is formed more towards the outside than the center Wc of the width W of the water jacket 2, so the length from the thin part 21 to the cylinder wall 10 increases, and it is more difficult for deformation of the head bolt boss 32 to reach the cylinder wall 10.

As the inner and outer surfaces of the water jacket base wall 20 are hollowed with a predetermined curvatures Rb, Ra, a large concentration of stress in the thin part 21 can be prevented when the water jacket base wall 20 sags.

In this way, deformation of the cylinder wall 10 can be suppressed, scuffing of the cylinder bore is suppressed, friction of the piston is reduced, and an engine fuel consumption is reduced. Further, a gap between the cylinder wall 10 and the piston can be kept uniform, and the amount of oil leaking to a crankcase from the gap can be reduced.

As the water jacket base wall 20 is inclined, the flowpath cross-sectional area of the lower part of the water jacket 2 is smaller, and the amount of cooling water circulating through the upper part of the water jacket 2 increases. As a result, the cooling effect of the upper part of the cylinder wall 10 exposed to combustion gas is increased, and the temperature distribution of the cylinder wall 10 can be made uniform.

Figure 3:
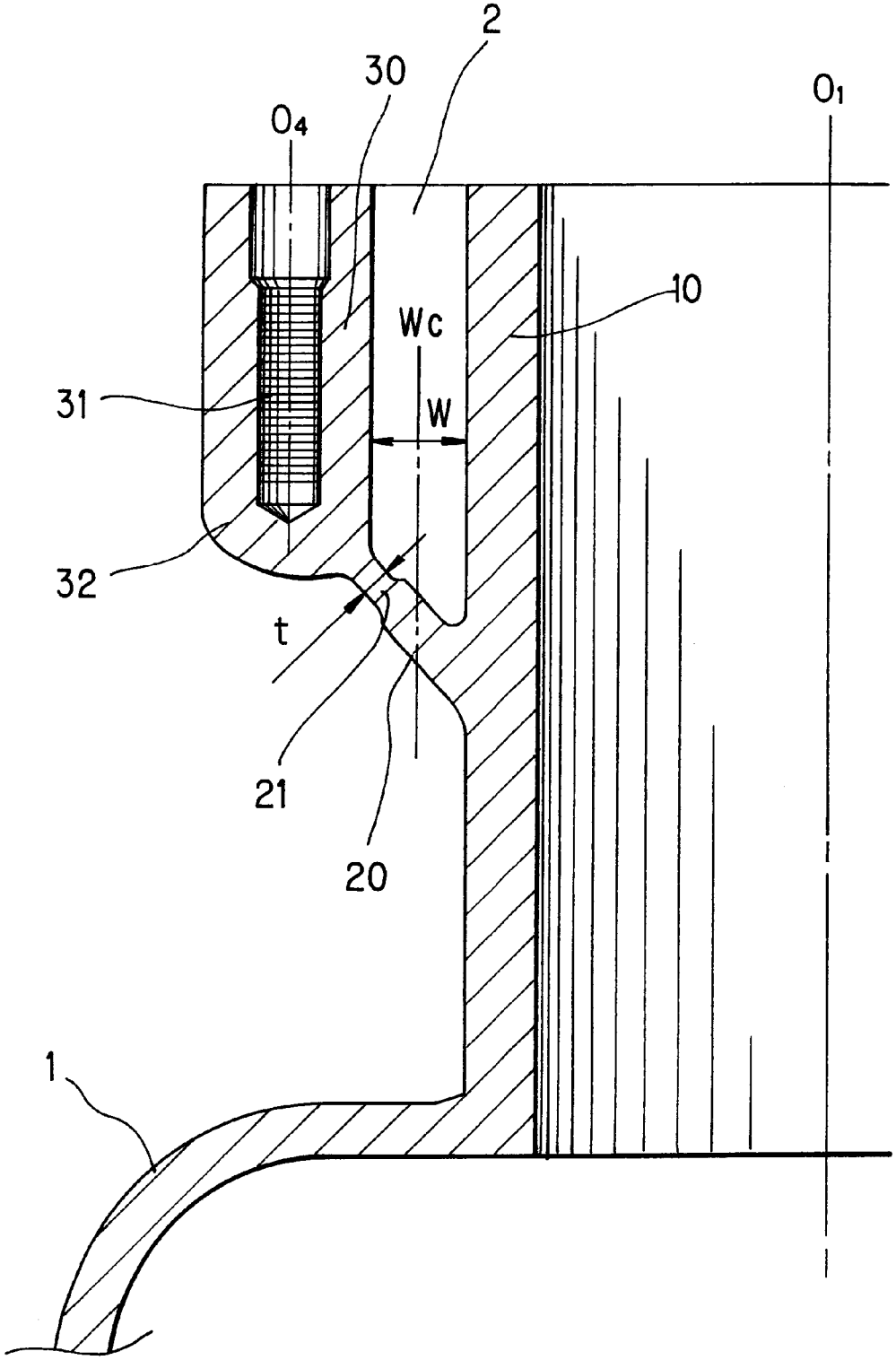
FIG. 3 is similar to FIG. 2, but showing a second embodiment of this invention.

FIG. 3 shows a second embodiment of this invention.

This embodiment differs from the first embodiment in that the thin part 21 is formed with a constant thickness part over a predetermined length to the edge of the water jacket base wall 20 and its end is directly connected to the water jacket outer wall 30. The thin part 21 is situated more towards the outside than the center Wc of the width W of the water jacket 2.

As the thin part 21 is formed so as to connect with the water jacket outer wall 30, the length from the thin part 21 to the cylinder wall 10 is longer. Due to this, it is more difficult for the axial force of the head bolt to be transmitted to the cylinder wall 10, and deformation of the cylinder wall 10 is completely suppressed.

Figure 4:
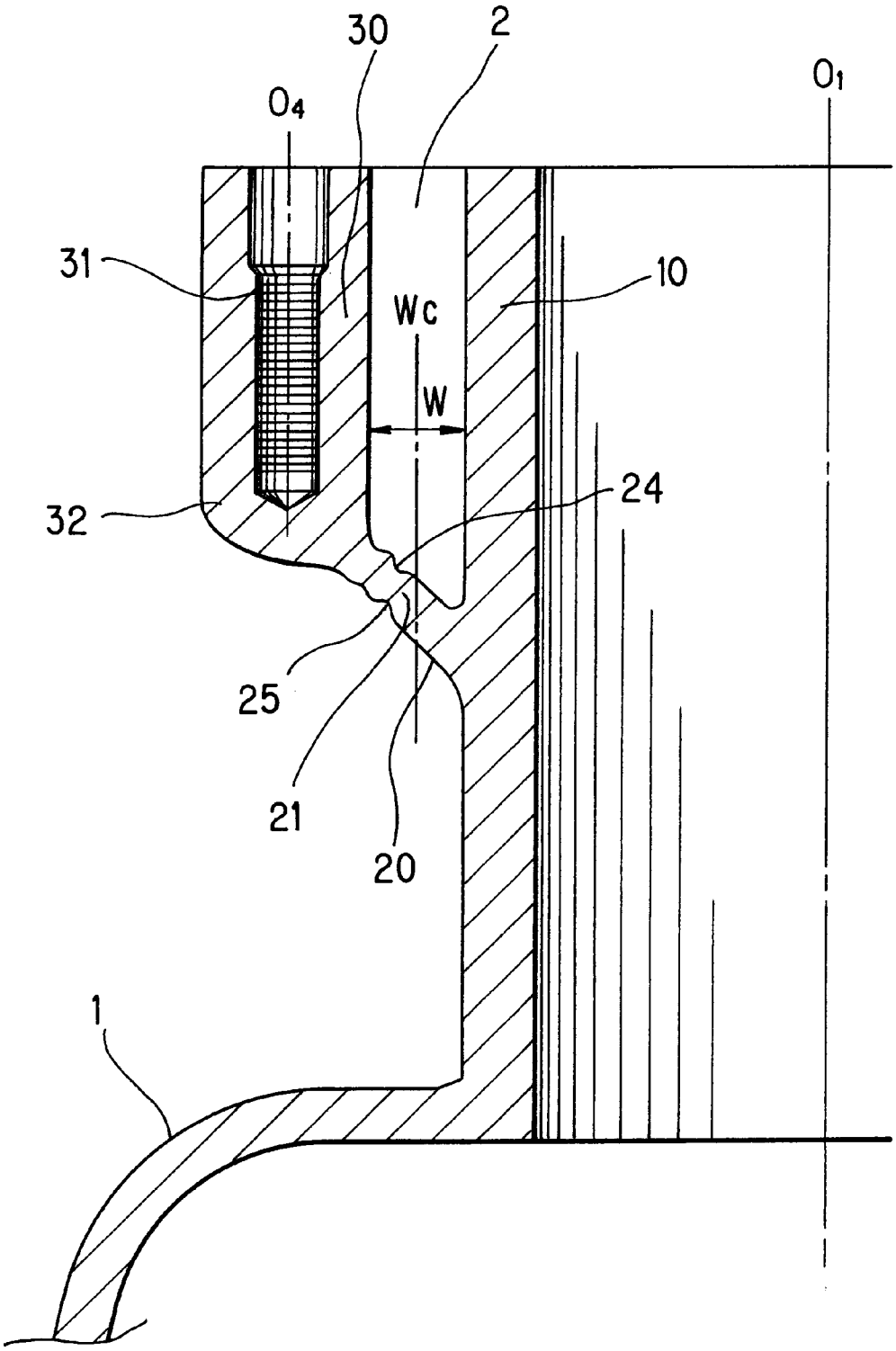
FIG. 4 is similar to FIG. 2, but showing a third embodiment of this invention.
Figure 5:
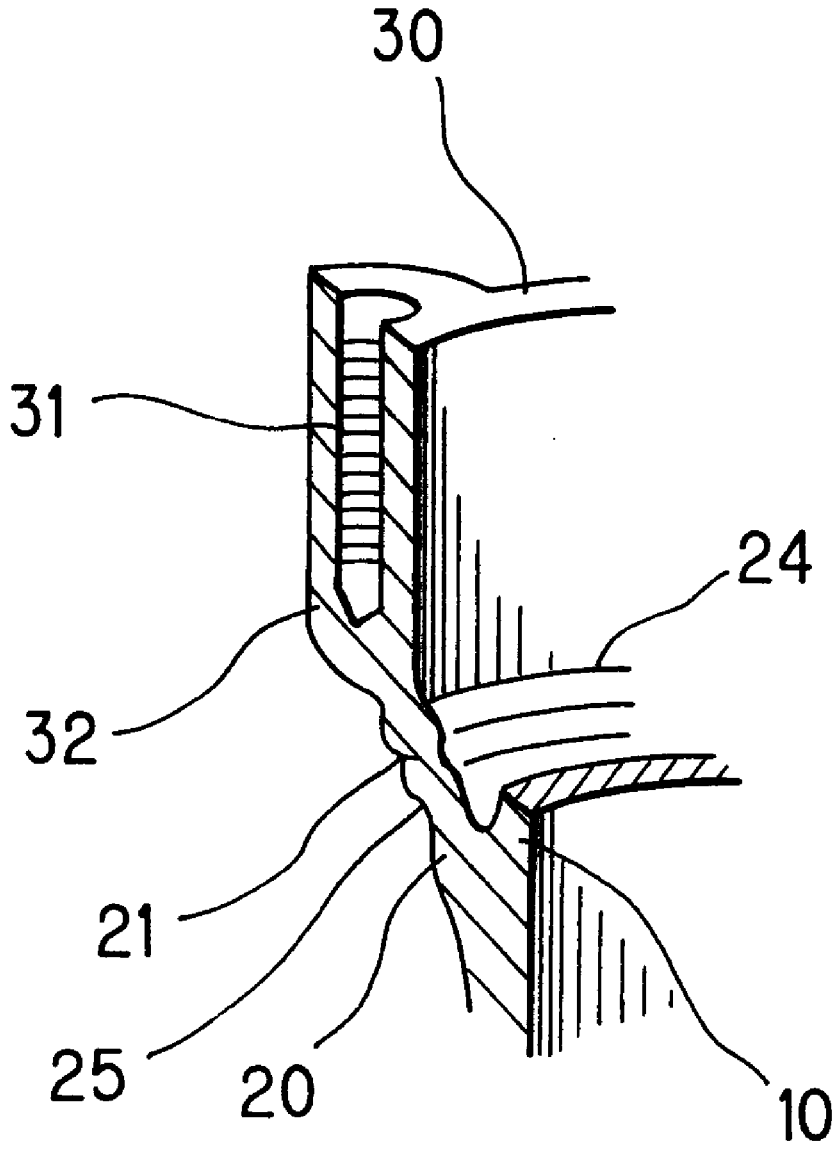
FIG. 5 is a partial perspective view of a cylinder block according to the third embodiment.

FIG. 4, FIG. 5 show a third embodiment of this invention.

This embodiment differs from the first embodiment in that the thin part 21 is formed by providing grooves 24, 25 on the inner surface and outer surface of the water jacket base wall 20 respectively such that the cross-section of the water jacket base wall 20 is undulated. The grooves 24, 25 are formed more towards the outside than the center Wc of width W of water jacket 2.

As the wall thickness of the water jacket base wall 20 is smaller where the grooves 24, 25 are formed, the rigidity of the water jacket base wall 20 is low. Therefore, sagging of the water jacket base wall 20 due to the axial force of the head bolt is promoted, and deformation of the cylinder wall 10 is suppressed.

Figure 6:
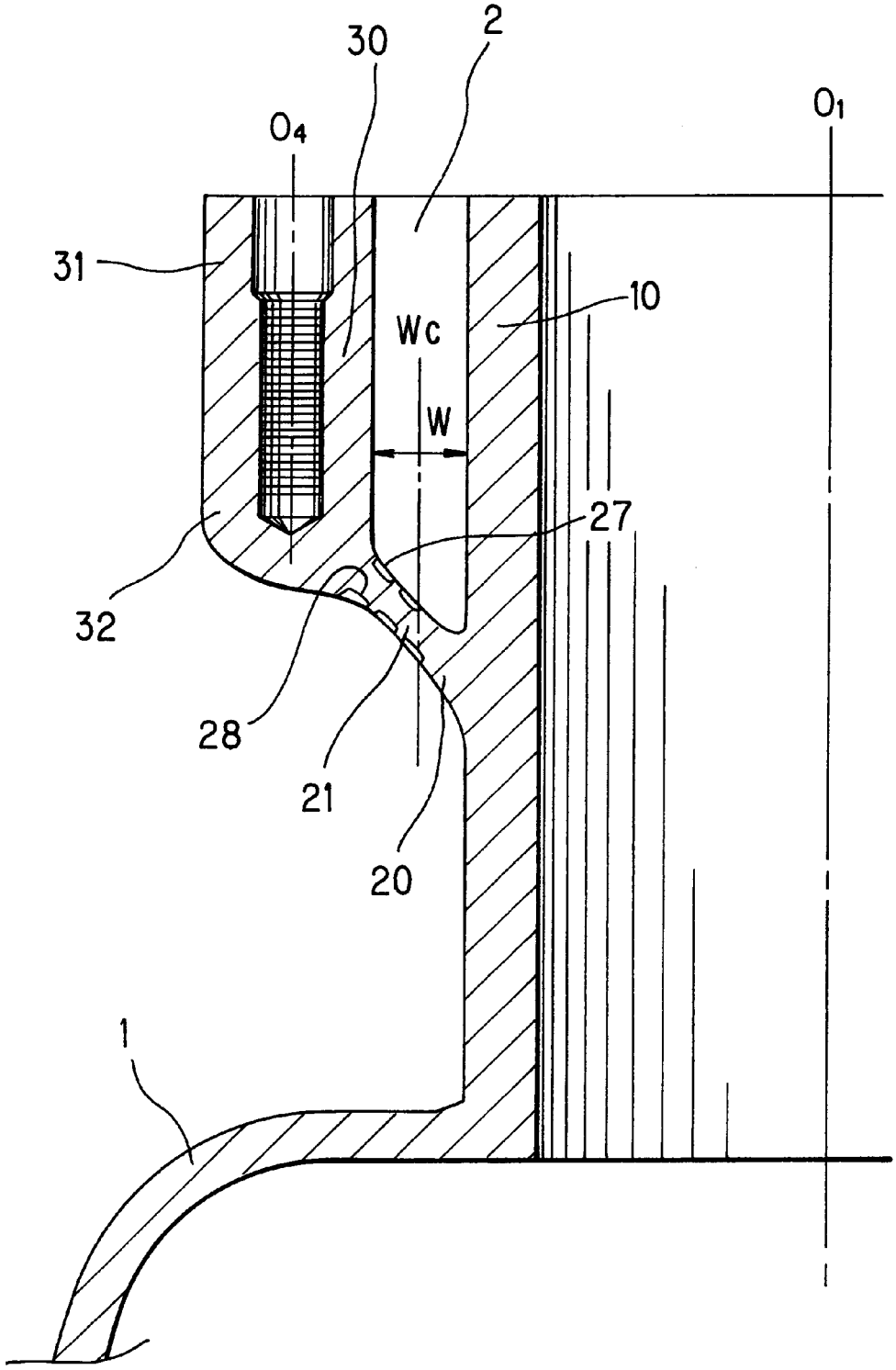
FIG. 6 is similar to FIG. 2, but showing a fourth embodiment of this invention.
Figure 7:
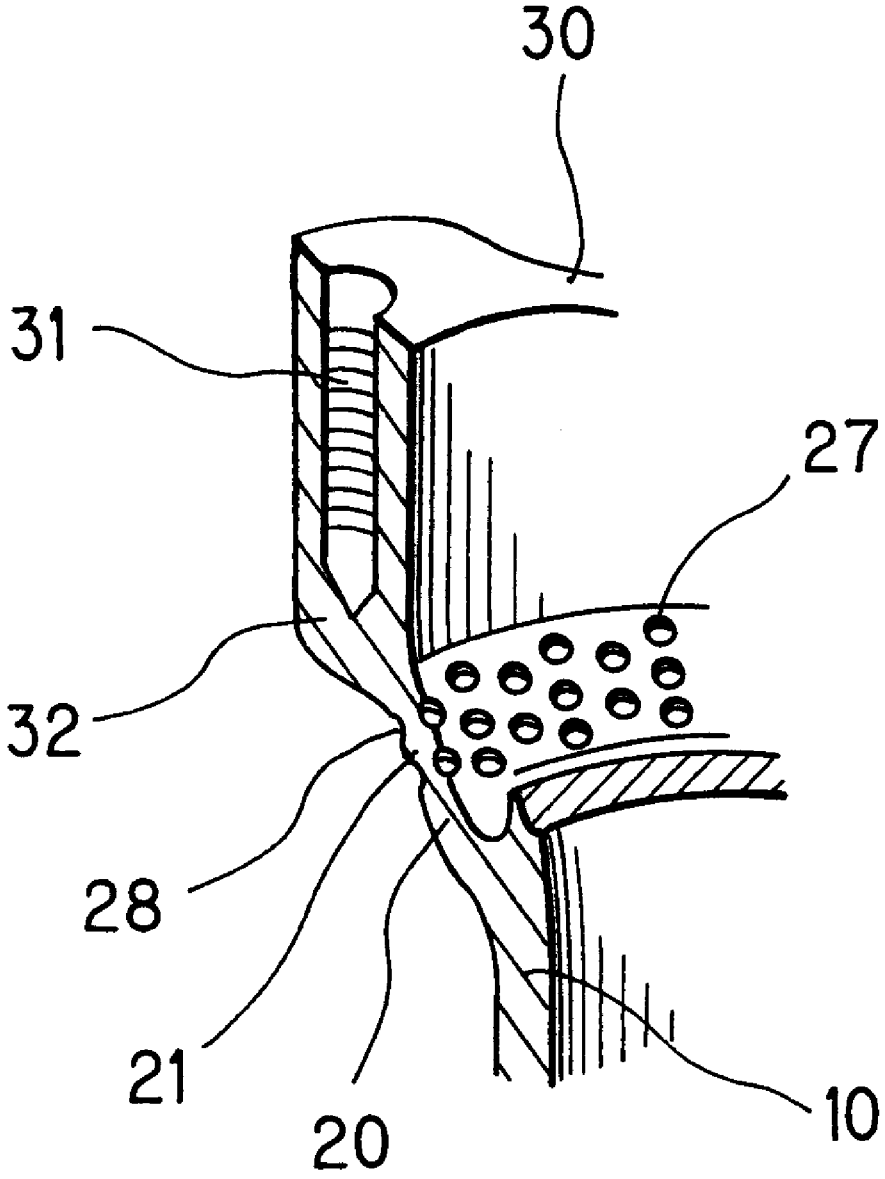
FIG. 7 is a partial perspective view of a cylinder block according to the fourth embodiment.

FIG. 6, FIG. 7 show a fourth embodiment of this invention.

This embodiment differs from the first embodiment in that the thin part 21 is formed by providing plural concave parts 27, 28 on the inner surface and outer surface of the water jacket base wall 20 respectively. The concave parts 27, 28 are formed more towards the outside than the center Wc of the width W of the water jacket 2.

As the thickness of the water jacket base wall 20 is smaller where the concave parts 27, 28 are formed and the rigidity of the water jacket base wall 20 is reduced, sagging of the water jacket base wall 20 due to the axial force of the head bolt is promoted, and deformation of the cylinder wall 10 is suppressed.

Figure 8:
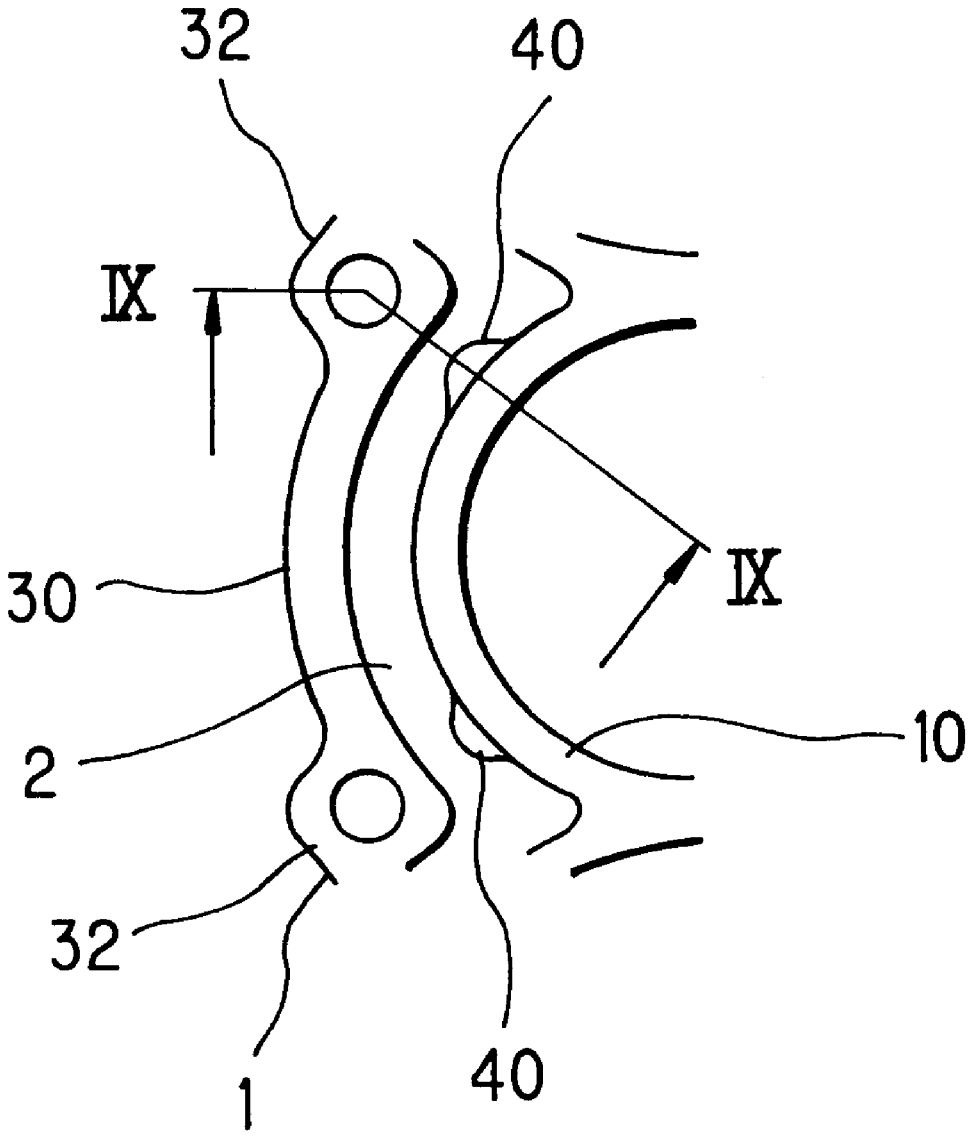
FIG. 8 is similar to FIG. 1, but showing a fifth embodiment of this invention.
Figure 9:
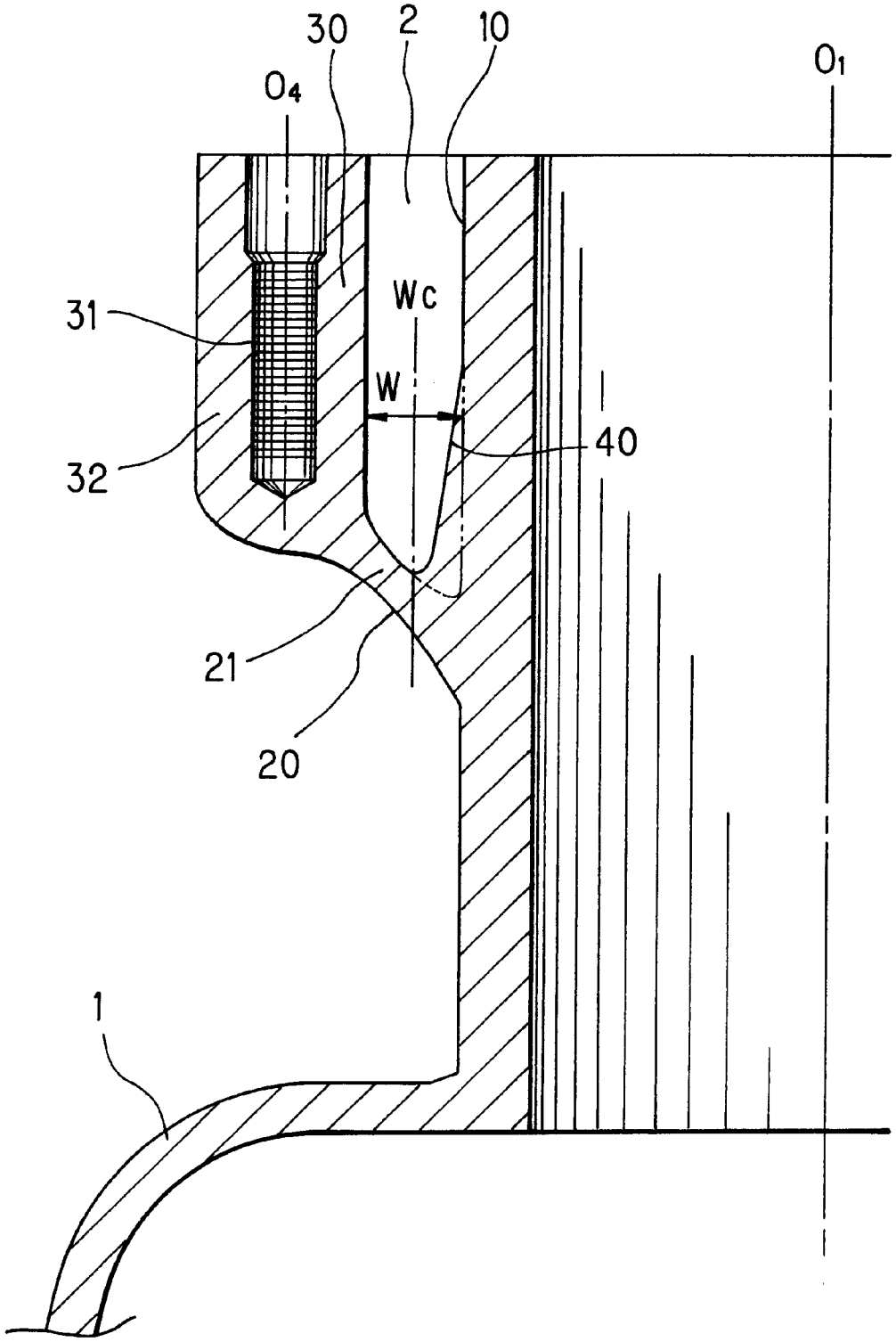
FIG. 9 is a partial sectional view of a cylinder block taken along a line IX—IX in FIG. 8.

FIG. 8, FIG. 9 show a fifth embodiment of this invention.

This embodiment differs from the first embodiment in that ribs 40 are formed connecting the cylinder wall 10 with the water jacket base wall 20, these ribs 40 extending from positions facing the head bolt bosses 32.

The ribs 40 are formed more towards the inside than the center Wc of the width W of the water jacket 2. The height of the ribs 40 from the cylinder wall 10 becomes progressively smaller with increasing distance from the water jacket base wall 20.

Due to the ribs 40, the rigidity of the cylinder wall 10 is effectively increased in the part receiving stress from the water jacket base wall 20, and deformation of the cylinder wall 10 is further suppressed. Therefore, the average wall thickness can be made small while ensuring rigidity of the cylinder wall 10, and the engine can be made lightweight.

Figure 10:
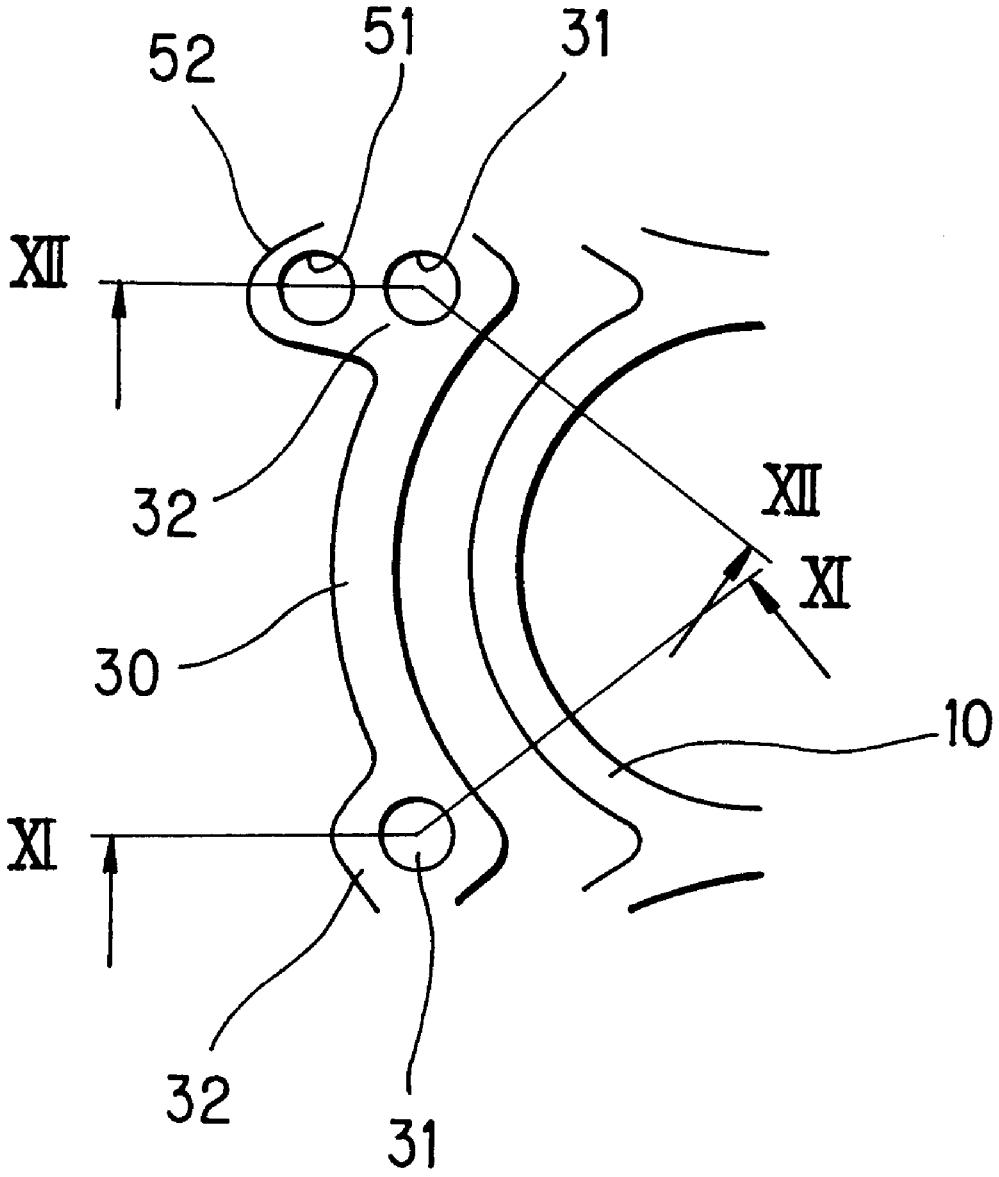
FIG. 10 is similar to FIG. 1, but showing a sixth embodiment of this invention.
Figure 11:
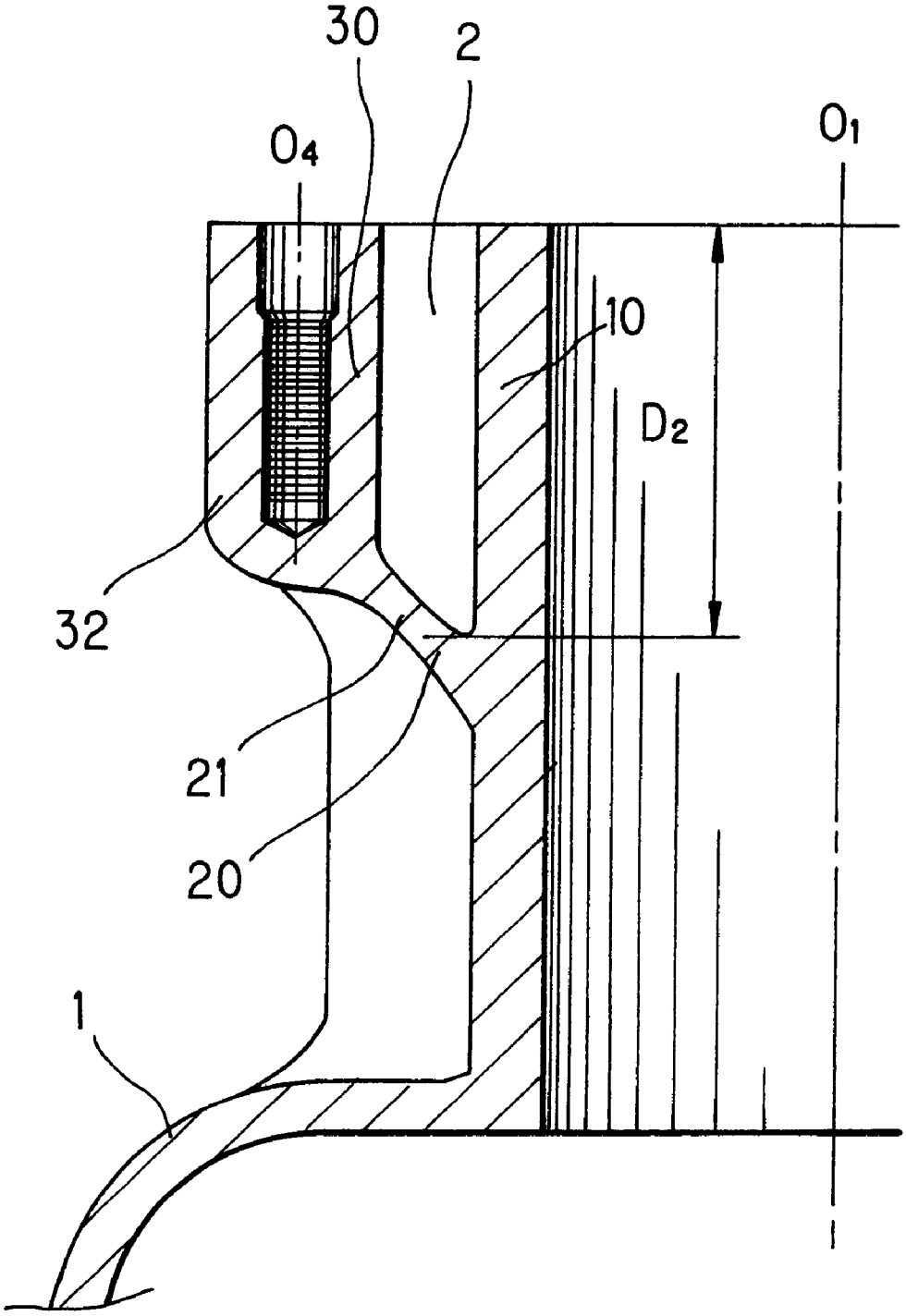
FIG. 11 is a partial sectional view of a cylinder block taken along a line XI—XI in FIG. 10.
Figure 12:
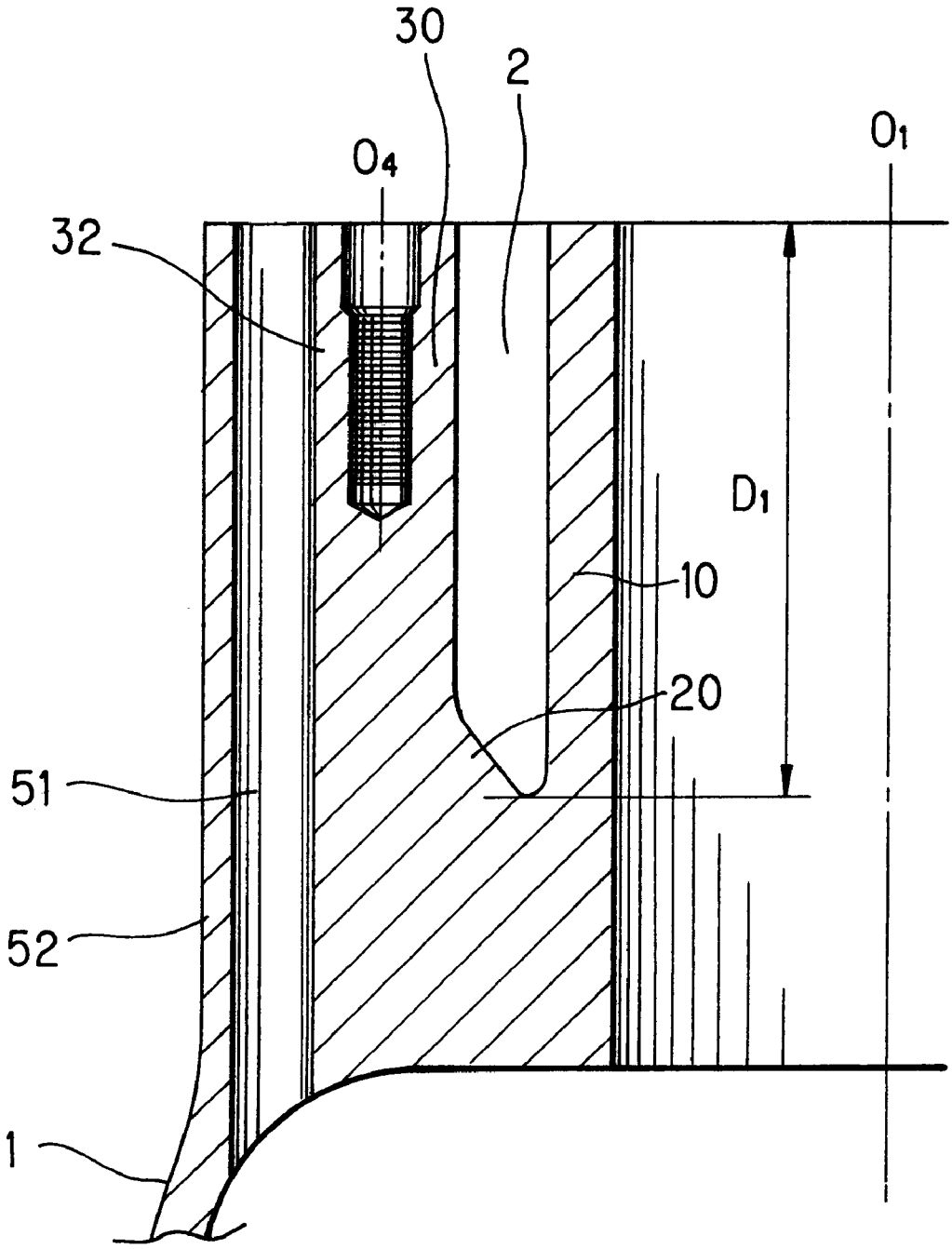
FIG. 12 is a partial sectional view of the cylinder block taken along a line XII—XII in FIG. 10.

FIG. 10–FIG. 12 show a sixth embodiment of this invention.

This embodiment differs from the first embodiment in that a wall 52 in a rib shape projects from the outer surface of the head bolt boss 32, and an oil trap 51 parallel with the center line $O_1$ of the cylinder is formed in the wall 52. The oil trap 51 allows lubricating oil which lubricates a valve system in the cylinder head, not shown, to flow to the crankcase.

The cylinder block 1 is formed so that the depth of the water jacket 2 is greater in a part adjacent to the oil trap 51. The cylinder block 1 is formed so that a depth $D_1$ at a position adjacent to the oil trap 51 of the water jacket 2 is larger than a depth $D_2$ at a position that is not adjacent to the oil trap 51 of the water jacket 2.

As shown in FIG. 11, the water jacket base wall 20 is inclined from the water jacket outer wall 30 towards the cylinder wall 10 in the part that is not adjacent to the oil trap 51, and the thin part 21 is formed midway along it. Due to this, deformation of the head bolt boss 32 due to the axial force of the head bolt is absorbed by elastic deformation of the water jacket base wall 20, and deformation of the cylinder wall 10 is suppressed.

As shown in FIG. 12, the thickness of the water jacket base wall 20 cannot be made small in a position near to the oil trap 51. However, by making the depth $D_1$ of the water jacket 2 large, the distance between the head bolt boss 32 and water jacket base wall 20 becomes large. Due to this, it is difficult for deformation of the head bolt boss 32 to transmit to the water jacket wall 20 and the cylinder wall 10, and elastic deformation of the cylinder wall 10 is suppressed.

Figure 13:
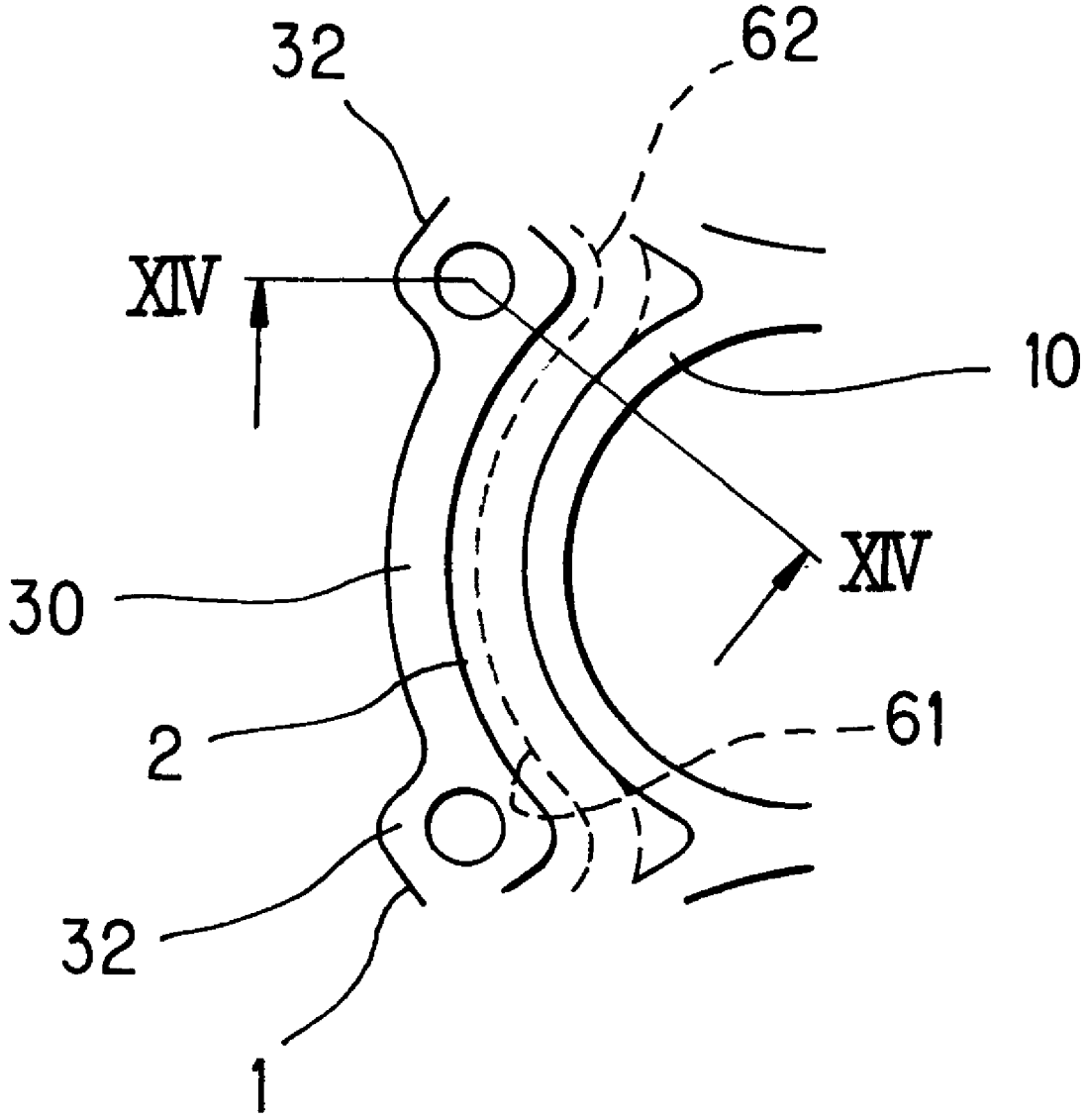
FIG. 13 is similar to FIG. 1, but shoving a seventh embodiment of this invention.
Figure 14:
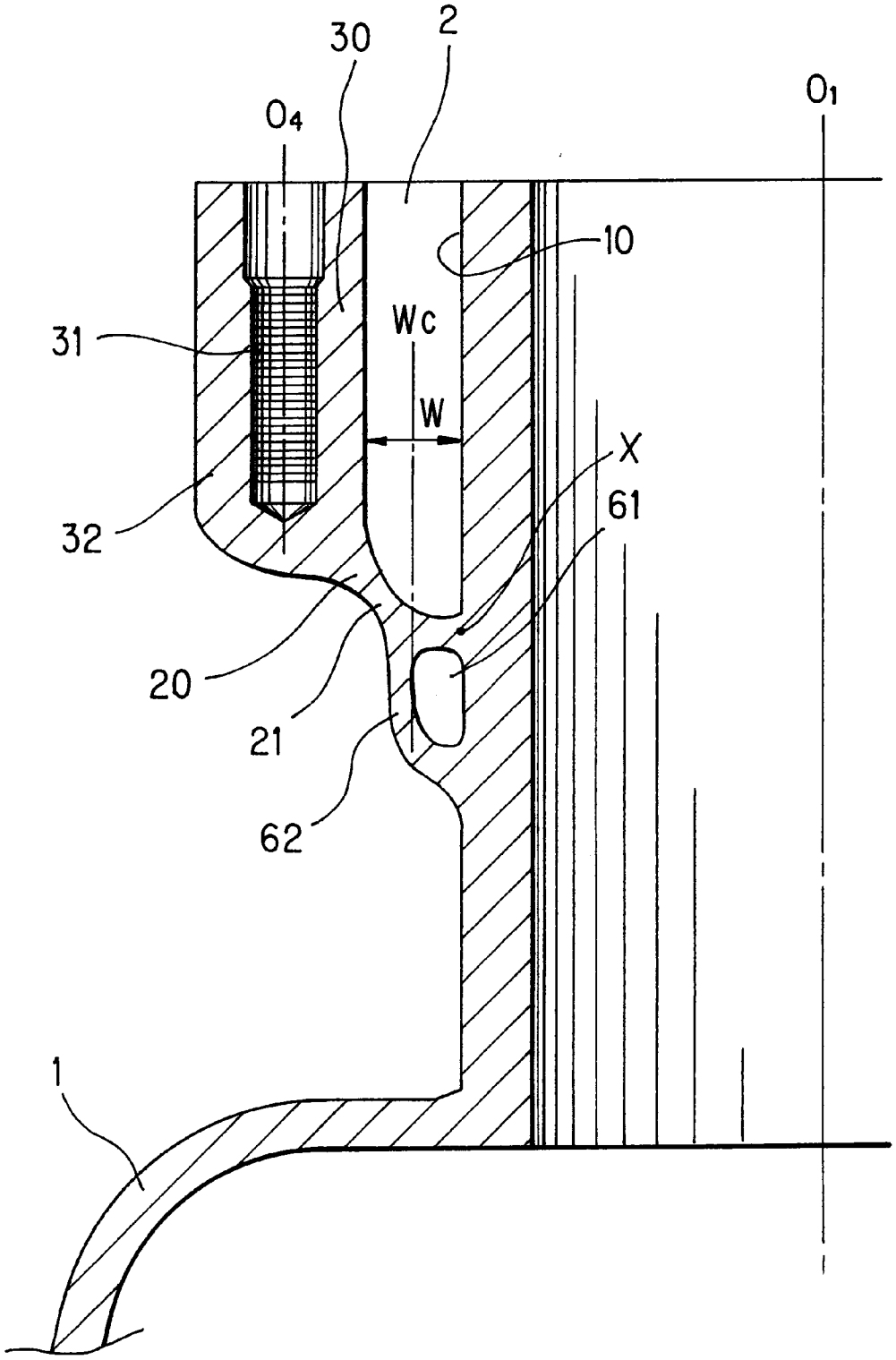
FIG. 14 is a partial sectional view of a cylinder block taken along a line XIV—XIV in FIG. 13.

FIG. 13, FIG. 14 show a seventh embodiment of this invention.

This embodiment differs from the first embodiment in that a gallery wall 62 is provided to connect a point midway in the water jacket base wall 20 with a point in the middle of the cylinder wall 10 which is lower than the point X. An oil gallery 61 is formed by the water jacket base wall 20, cylinder wall 10 and gallery wall 62.

The oil gallery 61 is formed along the cylinder wall 10 such that its center is situated is further inside than the center Wc of the width W of the water jacket 2. The oil gallery 61 supplies a valve system, not shown, with oil.

As the gallery wall 62 is formed between the water jacket base wall 20 and cylinder wall 10, the rigidity of the cylinder wall 10 is increased, and elastic deformation of cylinder wall 10 is suppressed.

The embodiments of this invention in which an exclusive property or privilege is claimed are defined as follows:

1. An open deck type cylinder block of a water-cooled engine comprising:

a cylinder having a cylinder wall and a piston reciprocally disposed therein, a water jacket outer wall having an upper portion which terminates in a spaced and connection free relationship with an upper portion of the cylinder wall, and a water jacket base wall connecting a lower end of a head bolt boss of said water jacket outer wall and said cylinder wall in a longitudinal section of the said head bolt boss, said water jacket base wall including means for reducing force transmission between the water jacket outer wall and the cylinder wall comprising: a portion which is formed in a predetermined position of said water jacket base wall which is thinner than remaining portions of said water jacket base wall in a longitudinal section of said head bolt boss and which is sufficiently flexible as to reduce force which is transmitted between the water jacket outer wall and the cylinder wall and to attenuate cylinder wall deformation, said cylinder wall, said water jacket outer wall and said water jacket base wall being unitarily die-cast together as parts of the open deck type cylinder block.

2. A cylinder block of a water-cooled engine as defined in claim 1, wherein said water jacket base wall slopes downwardly from said water jacket outer wall toward said cylinder wall.

3. A cylinder block of a water-cooled engine as defined in claim 1, wherein said thin part is formed further towards the outside than the center of the width of said water jacket.

4. A cylinder block of a water-cooled engine as defined in claim 1, wherein said thin part is formed by hollowing one of an inner surface and an outer surface of said water jacket base wall so as to have a predetermined curvature.

5. A cylinder block of a water-cooled engine as defined in claim 1, wherein said thin part is formed immediately adjacent said water jacket outer wall.

6. A cylinder block of a water-cooled engine as defined in claim 1, wherein said thin part is formed further towards the outside than the center of the width of said water jacket and is directly connected to said water jacket outer wall.

7. A cylinder block of a water-cooled engine as defined in claim 1, wherein said thin part is formed by providing a groove along said cylinder wall in one of an inner surface and an outer surface of said water jacket base wall.

8. A cylinder block of a water-cooled engine as defined in claim 1, wherein said thin part is formed further towards the outside than the center of the width of said water jacket by providing a groove along said cylinder wall in one of an inner surface and an outer surface of said water jacket base wall.

9. A cylinder block of a water-cooled engine as defined in claim 1, wherein said thin part is formed by providing plural concave portions in one of an inner surface and an outer surface of said water jacket base wall.

10. A cylinder block of a water-cooled engine as defined in claim 1, wherein said thin part is formed further towards the outside than the center of the width of said water jacket by providing plural concave portions in one of an inner surface and an outer surface of said water jacket base wall.

11. A cylinder block of a water-cooled engine comprising:

a cylinder having a cylinder wall and a piston reciprocally disposed therein, a water jacket outer wall covering an upper part of said cylinder wall so as to form a gap therebetween, and a water jacket base wall connecting the lower end of said water jacket outer wall and said cylinder wall, said water jacket base wall having a thin part formed at a predetermined position of said water jacket base wall so as to be thinner than other parts of said water jacket base wall, wherein the cylinder wall, water jacket outer wall and water jacket base wall form a water jacket through which cooling water flows, said cylinder block further comprising a head bolt boss into which a head bolt is screwed and a rib connecting said water jacket base wall and said cylinder wall in a position facing said head bolt boss.

12. A cylinder block of a water-cooled engine comprising:

a cylinder having a cylinder wall and a piston reciprocally disposed therein, a water jacket outer wall covering an upper part of said cylinder wall so as to form a gap therebetween, and a water jacket base wall connecting the lower end of said water jacket outer wall and said cylinder wall, said water jacket base wall having a thin part formed at a predetermined position of said water jacket base wall so as to be thinner than other parts of said water jacket base wall, wherein the cylinder wall, water jacket outer wall and water jacket base wall form a water jacket through which cooling water flows, said cylinder block further comprising a head bolt boss into which a head bolt is screwed and a wall in a rib shape projecting from said head bolt boss, said wall having an oil trap therein, wherein the depth of said water jacket is deepened in a part adjacent to said oil trap.

13. A cylinder block of a water-cooled engine comprising:

a cylinder having a cylinder wall and a piston reciprocally disposed therein, a water jacket outer wall covering an upper part of said cylinder wall so as to form a gap therebetween, and a water jacket base wall connecting the lower end of said water jacket outer wall and said cylinder wall, said water jacket base wall having a thin part formed at a predetermined position of said water jacket base wall so as to be thinner than other parts of said water jacket base wall, wherein the cylinder wall, water jacket outer wall and water jacket base wall form a water jacket through which cooling water flows, said cylinder block further comprising a gallery wall which connects said cylinder wall with said water jacket base wall, and an oil gallery formed by said water jacket base wall, said cylinder wall and said gallery wall.

* * * * *